US009739099B2

(12) United States Patent
Carter et al.

(10) Patent No.: US 9,739,099 B2
(45) Date of Patent: Aug. 22, 2017

(54) INSULATIVE COATING PROCESSES FOR ELECTROMAGNETIC TELEMETRY MANDRELS

(71) Applicant: Halliburton Energy Services, Inc., Houston, TX (US)

(72) Inventors: Daniel Patrick Carter, Conroe, TX (US); Will Edgar Hendricks, Houston, TX (US); Chuka Benjamin Onya, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 588 days.

(21) Appl. No.: 14/345,548

(22) PCT Filed: Sep. 30, 2013

(86) PCT No.: PCT/US2013/062630

§ 371 (c)(1),
(2) Date: Mar. 18, 2014

(87) PCT Pub. No.: WO2014/055412

PCT Pub. Date: Apr. 10, 2014

(65) Prior Publication Data

US 2014/0338885 A1 Nov. 20, 2014

Related U.S. Application Data

(60) Provisional application No. 61/710,353, filed on Oct. 5, 2012.

(51) Int. Cl.
*E21B 17/00* (2006.01)
*E21B 47/12* (2012.01)
(Continued)

(52) U.S. Cl.
CPC ..... *E21B 17/003* (2013.01); *B05D 1/08* (2013.01); *B05D 1/36* (2013.01); *C23C 4/02* (2013.01);
(Continued)

(58) Field of Classification Search
CPC ..... E21B 17/00; E21B 17/003; E21B 47/122; C23C 4/11; C23C 4/02; C23C 4/18;
(Continued)

(56) References Cited

U.S. PATENT DOCUMENTS

2002/0066491 A1 6/2002 Lively
2004/0104047 A1 6/2004 Peter
(Continued)

FOREIGN PATENT DOCUMENTS

GB 2411917 A 9/2005
RU 2278258 C1 6/2006
(Continued)

OTHER PUBLICATIONS

Fauchais et al., "Thermal Sprayed Coatings Used Against Corrosion and Corrosive Wear," SPCTS, UMR 7315, University of Limoges (2012).

(Continued)

*Primary Examiner* — Yong-Suk (Philip) Ro
(74) *Attorney, Agent, or Firm* — McDermott Will & Emery LLP

(57) ABSTRACT

A process for applying an insulative coating to a mandrel can be used in an electromagnetic telemetry antenna assembly. One process includes applying a bond coat to at least a portion of an outer radial surface of a mandrel; applying an electrical isolation layer to the bond coat; applying a first sealant layer to the electrical isolation layer; and heat treating the mandrel in an oven.

11 Claims, 1 Drawing Sheet

(51) Int. Cl.

| | |
|---|---|
| ***B05D 1/08*** | (2006.01) |
| ***B05D 1/36*** | (2006.01) |
| ***C23C 4/02*** | (2006.01) |
| ***C23C 4/18*** | (2006.01) |
| ***C23C 4/11*** | (2016.01) |
| *B05D 7/00* | (2006.01) |

(52) U.S. Cl.
CPC ..... *C23C 4/11* (2016.01); *C23C 4/18* (2013.01); *E21B 47/122* (2013.01); *B05D 7/542* (2013.01); *B05D 7/582* (2013.01); *B05D 7/584* (2013.01)

(58) Field of Classification Search
CPC . B05D 1/08; B05D 1/36; B05D 7/542; B05D 7/582; B05D 7/584
See application file for complete search history.

(56) References Cited

U.S. PATENT DOCUMENTS

| | | | |
|---|---|---|---|
| 2005/0167098 | A1 | 8/2005 | Lovell et al. |
| 2006/0201717 | A1 | 9/2006 | Cramer |
| 2006/0220650 | A1 | 10/2006 | Lovell et al. |
| 2007/0131412 | A1 | 6/2007 | Finci et al. |
| 2009/0159146 | A1 | 6/2009 | Jackson et al. |

FOREIGN PATENT DOCUMENTS

| | | | | | |
|---|---|---|---|---|---|
| WO | 0022329 | A2 | | 4/2000 | |
| WO | 2009032504 | A1 | | 3/2009 | |
| WO | WO 2012082748 | | * | 6/2012 | ..... E21B 17/003 |
| WO | 2014055412 | A1 | | 4/2014 | |

OTHER PUBLICATIONS

International Search Report and Written Opinion for PCT/US2013/062630 dated Jan. 7, 2014.
European Supplementary Search Report dated Apr. 11, 2016, received in corresponding EP Application No. 13843211.
Office Action received in corresponding Russian Patent Application No. 2015106728, dated May 23, 2016.

* cited by examiner

INSULATIVE COATING PROCESSES FOR ELECTROMAGNETIC TELEMETRY MANDRELS

This application is a National Stage entry of and claims priority to International Application No. PCT/US2013/062630, filed on Sep. 30, 2013, which further claims priority to U.S. Provisional Patent Application No. 61/710,353 filed on Oct. 5, 2012.

BACKGROUND

The embodiments herein relate to downhole electromagnetic telemetry systems and, more particularly, to insulative coating processes for electromagnetic telemetry antenna assemblies.

In measurement while drilling (MWD) applications, a variety of communication and transmission techniques are used to provide real time data from the vicinity of a drill bit to the surface during drilling operations. One technique uses a downhole antenna associated with the drill string and an MWD tool to transmit electromagnetic waves through the earth and to a receiver arranged at the surface. The receiver receives and records the electromagnetic data, thereby providing an operator with real time data associated with drilling parameters such as bit weight, torque, and wear and bearing conditions. MWD applications may also provide an operator with real time data associated with the physical properties of the subterranean formation being drilled such as pressure, temperature, and wellbore trajectory. Consideration of such information can result in faster penetration rates, better trip planning, reduced equipment failures, fewer delays for directional surveys, and the elimination of the need to interrupt drilling for abnormal pressure detection.

As an integral part of the MWD tool, the downhole antenna is housed in a mandrel that electrically isolates two portions of drill string, thereby creating suitable antenna capabilities. In order to electrically isolate the two portions of the drill string, the mandrel will typically include an insulative coating applied to its exterior surface. It has been found, however, that certain processes used in applying the insulative coating to the mandrel have resulted in coating inconsistencies and/or contamination. For instance, current coating processes often allow the coating to become contaminated by allowing moisture in the air or from cutting and sizing operations to permeate into the coating. As a result, the insulative coating will be more susceptible to failure in harsh downhole environments. Failure of the coating removes the electrical isolation, which equates to a failure of the antenna and the inability to perform MWD.

BRIEF DESCRIPTION OF THE DRAWINGS

The following figures are included to illustrate certain aspects of the embodiments disclosed herein, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The embodiments herein relate to downhole electromagnetic telemetry systems and, more particularly, to insulative coating processes for electromagnetic telemetry antenna assemblies.

Figure 1:
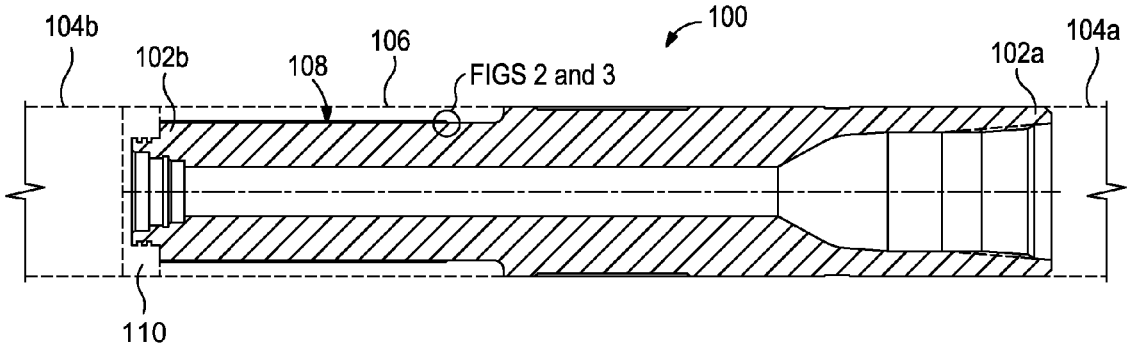
FIG. 1 illustrates a cross-sectional side view of an exemplary mandrel that may house an antenna used in a downhole electromagnetic telemetry system, according to one or more embodiments.

Referring to FIG. 1, illustrated is a cross-sectional view of an exemplary mandrel 100 that may form part of an antenna used in a downhole electromagnetic telemetry system, according to one or more embodiments. In particular, the mandrel 100 may be used as an integral part of the antenna for a measurement while drilling (MWD) tool. As illustrated, the mandrel 100 may have an uphole end 102*a* and a downhole end 102*b*. The uphole end 102*a* of the mandrel 100 may be coupled or otherwise attached to an uphole drill string section 104*a*, and the downhole end 102*b* of the mandrel 100 may be coupled or otherwise attached to a downhole drill string section 104*b*. In at least one embodiment, as illustrated, a sleeve 106 and a hang-off collar 110 (shown in phantom) may be incorporated into the downhole end 102*b* of the mandrel 100 and otherwise facilitate the coupling of the downhole end 102*b* to the downhole drill string section 104*b*.

The mandrel 100 may exhibit a variety of sizes including, but not limited to, 8.89 cm (3.5 in), 12.065 cm (4.75 in), 16.51 cm (6.5 in), 20.32 cm (8 in), and 24.13 cm (9.5 in). In operation, the mandrel 100 may be configured to electrically isolate the uphole drill string section 104*a* from the downhole drill string section 104*b*. Electrical isolation allows electromagnetic signals to be generated for data telemetry and to be transmitted to the surface. To at least partially accomplish this, a layer or substrate of electrical insulation 108 may be applied to a portion of the mandrel 100.

For example, the electrical insulation 108 may be applied to a reduced-diameter portion of the mandrel 100, which may be configured to accommodate the sleeve 106 for coupling the mandrel 100 to the downhole drill string section 104*b*. In other embodiments, the electrical insulation 108 may be applied to any other portion of the mandrel 100, without departing from the scope of the disclosure. For example, in some embodiments, the electrical insulation 108 may be applied to the outer radial surface of the entire mandrel 100. In other embodiments, the electrical insulation 108 may instead be applied to a portion of the uphole end 102*a* of the mandrel 100, without departing from the scope of the disclosure.

Figure 2:
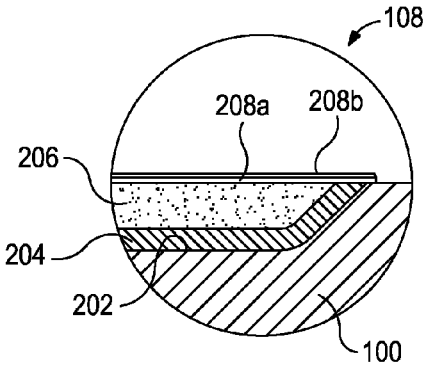
FIG. 2 illustrates an enlarged view of an exemplary electrical insulation, according to one or more embodiments.

Referring to FIG. 2, with continued reference to FIG. 1, an enlarged view of the layer of electrical insulation 108 is illustrated, according to one or more embodiments. As illustrated, the electrical insulation 108 may be applied to an outer radial surface 202 of the mandrel 100. In some embodiments, the mandrel 100 may be made of a base metal such as, but not limited to, steel, stainless steel, a steel alloy, or any conventional metal suitable for downhole use. The electrical insulation 108 may include a bond coat 204 applied directly to the outer radial surface 202 of the mandrel 100 and an electrical isolation layer 206 applied on top of the bond coat 204. The bond coat 204 may provide a substrate configured to facilitate a more suitable adhering surface for the electrical isolation layer 206. In at least one embodiment, the bond coat 204 may be a nickel-chromium alloy. In other embodiments, the bond coat 204 may be any other substrate material that may help facilitate a proper bonding for the subsequent electrical isolation layer 206 including, but not limited to, molybdenum, nickel-aluminum composites, aluminum bronze, pre-alloyed nickel aluminum, or a zinc-based alloy.

The isolation layer 206 may be applied to the bond coat 204 using a thermal spraying technique. For example, in at least one embodiment, the isolation layer 206 may be applied to the bond coat 204 using high velocity oxy-fuel coating processes. In other embodiments, the isolation layer 206 may be applied to the bond coat 204 using any other thermal spraying technique such as, but not limited to, plasma spraying, detonation spraying, wire arc spraying, flame spraying, warm spraying, cold spraying, combinations thereof, or the like.

The electrical isolation layer 206 may be made of any material that provides electrical isolation between opposing metal surfaces or interfaces. In some embodiments, for example, the electrical isolation layer 206 may be a ceramic including, but not limited to, zirconium oxide, aluminum oxide, chromium oxide, titanium oxide, dioxides thereof, any combination thereof. In other embodiments, the electrical isolation layer 206 may be any other type of ceramic. As will be appreciated by those skilled in the art, using a ceramic as the electrical isolation layer 206 may prove advantageous on account of the high strength of ceramics, the ability of ceramics to withstand the elevated pressures and temperatures often experienced in harsh downhole environments, and the corrosion resistance of ceramics. Ceramics may also prove advantageous on account of their being an excellent electrical isolating material. In yet other embodiments, however, the electrical isolation layer 206 may be made of baked glass, porcelain (e.g., clay, quartz or alumina, feldspar, etc.), a polymeric material, a resin material (including natural or synthetic resins), a plastic, any composites thereof, any combinations thereof, or the like.

In order to prevent undesirable contamination of or damage to the isolation layer 206, a sealant 208, such as a first sealant layer 208*a*, may be applied to the isolation layer 206. In some embodiments, the first sealant layer 208*a* may be of any material capable of forming a protective barrier against gases and liquids. In some embodiments, the first sealant layer 208*a* may be a thermal sealant that is resistant to high temperature, such as those encountered in downhole environments. In some embodiments, the first sealant layer 208*a* may be made of materials including, but not limited to, an epoxy, a phenolic, a furan, a polymethacrylate, a silicone, a polyester, a polyurethane, a polyvinylester, a wax, phosphoric acid, an aluminum phosphate, a sodium silicate, an ethyl silicate, chromic acid, and any combinations thereof. In other embodiments, the first sealant layer 208*a* may be made by a sol-gel process in which a stable sol (or colloidal suspension) precursor is hydrolyzed into to a gel, followed by calcination of the gel at elevated temperature to an oxide. The sol precursors may be metal alkoxides, nitrates, hydroxides, and any combination thereof.

In some embodiments, the first sealant layer 208*a* may be applied directly to the electrical isolation layer 206. The first sealant layer 208*a* may be configured as a thermal spray sealer, as known by those skilled in the art. Once dried and cured, the first sealant layer 208*a* may form a protective barrier against gases and liquids. In some embodiments, the first sealant layer 208*a* is applied to the electrical isolation layer 206 immediately after the electrical isolation layer 206 is deposited on the mandrel 100. The first sealant layer 208*a* may be configured to seal any existing porosity within the electrical isolation layer 206 that may otherwise be permeated by moisture in the atmosphere or other contaminants.

The first sealant layer 208*a* may also be configured to protect the electrical isolation layer 206 during subsequent machining operations, which could also compromise the integrity of the electrical isolation layer 206. For instance, following the application of the first sealant layer 208*a*, the mandrel 100 may be machined to final sizing. Such machining may involve turning, milling, and/or grinding the mandrel 100 until proper tolerances are achieved. The first sealant layer 208*a* may protect the electrical isolation layer 206 from machining debris and/or any cutting fluid used.

The mandrel 100 may then be heat treated (e.g., baked) in an oven at an elevated temperature. In some embodiments, the elevated temperature may be any temperature exceeding the boiling point of water. Heat treating the mandrel 100 may be configured to remove any remaining moisture and/or cutting fluids from the surface of the mandrel 100 and, in particular, from the electrical isolation layer 206 and/or the first sealant layer 208*a*. For instance, moisture from the air or machining fluids may have contaminated the electrical isolation layer 206 and/or the first sealant layer 208*a* before, during, and/or after the final sizing operations.

In some embodiments, following the heat treatment, a second sealant layer 208*b* may be applied to the electrical isolation layer 206. In at least one embodiment, the second sealant layer 208*b* may be applied to or otherwise about the first sealant layer 208*a* while the mandrel 100 is still warm from the heat treatment or otherwise before it cools to room temperature. The second sealant layer 208*b* may be made of one or more of the materials listed above for the first sealant layer 208*a* and may also serve to form a protective barrier against gases and liquids. Moreover, the second sealant layer 208*b* may also be a thermal sealant that is resistant to high temperature, such as those encountered in downhole environments. Accordingly, in at least one embodiment, the mandrel 100 may have two layers of sealant 208, first sealant layer 208*a* and second sealant layer 208*b*, applied to the electrical isolation layer 206 to protect the electrical isolation layer 206 from contamination and/or damage.

Figure 3:
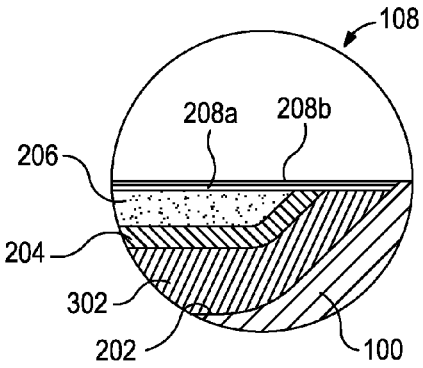
FIG. 3 illustrates an enlarged view of another exemplary electrical insulation, according to one or more embodiments.

Referring now to FIG. 3, with continued reference to FIG. 2, an enlarged view of another embodiment of the electrical insulation 108 is illustrated, according to one or more embodiments. As illustrated, the electrical insulation 108 may again include the bond coat 204 and the electrical isolation layer 206 applied on top of the bond coat 204. However, the electrical insulation 108 of FIG. 3 may further include a buffer layer 302 interposing the bond coat 204 and the outer radial surface 202 of the mandrel 100. In some embodiments, for instance, the bond coat 204 may have difficulty bonding with the outer radial surface 202 of the mandrel 100, and the buffer layer 302 may be applied to allow for increased bonding capabilities of the bond coat 204. This may prove especially advantageous in embodiments where the mandrel 100 exhibits austenitic-nonmagnetic properties. In at least one embodiment, the buffer layer 302 may be made of INCONEL® 625 or any other austenitic nickel-chromium-based alloy.

The electrical insulation 108 illustrated in FIG. 3 may be applied to the mandrel 100 using a process substantially similar to the process described above with reference to FIG. 2. Accordingly, the electrical insulation 108 may be applied using a double sealing process, including the first sealant layer 208*a* and the second sealant layer 208*b*. Past attempts used only one sealing process or no sealers at all. By applying the sealer 208 directly to the isolation layer 206, the insulation properties of the mandrel 100 may be increased and the isolation layer 206 is prevented from absorbing moisture from the atmosphere.

In some embodiments, the bond coat 204 may be applied onto the outer radial surface 202 of the mandrel 100 in the range of between about 0.00254 cm (0.001 in) to about 0.127 cm (0.05 in) thick, and any thickness therebetween. In some embodiments, the electrical isolation layer 206 may be applied to the bond coat 204 in the range of between about 0.0254 cm (0.01 in) to about 1.27 cm (0.5 in) thick, and any value therebetween. In at least one embodiment, the electrical isolation layer 206 may be applied to a thickness of about 0.0762 cm (0.030 in). In some embodiments, the buffer layer 302 may be applied onto the outer radial surface 202 of the mandrel 100 in the range of between about 0.0254 cm (0.01 in) to about 1.27 cm (0.5 in) thick, and any value therebetween.

Embodiments disclosed herein include:

A. A mandrel that includes an elongate body having a first end and a second end, electrical insulation applied to at least a portion of the elongate body, the electrical insulation comprising a bond coat applied to an outer radial surface of the elongate body and an electrical isolation layer applied on top of the bond coat, and a first sealant layer applied to the electrical isolation layer followed by a heat treatment of the mandrel.

B. A process that includes applying electrical insulation to an outer radial surface of a mandrel, the electrical insulation comprising a bond coat and an electrical isolation layer, applying a first sealant layer to the electrical isolation layer, and heat treating the mandrel in an oven.

Each of embodiments A and B may have one or more of the following additional elements in any combination: Element 1: further comprising a second sealant layer applied to the first sealant layer. Element 2: wherein the first and second sealant layers comprise a material selected from the group consisting of an epoxy, a phenolic, a furan, a polymethacrylate, a silicone, a polyester, a polyurethane, a polyvinylester, a wax, phosphoric acid, an aluminum phosphate, a sodium silicate, an ethyl silicate, chromic acid, and any combinations thereof. Element 3: wherein the second sealant layer is applied to the first sealant layer following heat treatment of the mandrel. Element 4: wherein the second sealant layer is applied to the first sealant layer prior to the mandrel reaching room temperature. Element 5: wherein the electrical insulation further comprises a buffer layer interposing the bond coat and the outer radial surface of the elongate body. Element 6: wherein the first and second ends are coupled to uphole and downhole drill string sections, respectively. Element 7: wherein the electrical insulation is applied to a reduced-diameter portion of the elongate body. Element 8: wherein the bond coat comprises a material selected from the group consisting of a nickel-chromium alloy, molybdenum, a nickel-aluminum composite, aluminum bronze, pre-alloyed nickel aluminum, and a zinc-based alloy. Element 9: wherein the electrical isolation layer comprises a material selected from the group consisting of zirconium oxide, aluminum oxide, chromium oxide, titanium oxide, dioxides thereof, baked glass, porcelain, a polymeric material, a resin material (including natural or synthetic resins), plastics, and any composites thereof. Element 10: wherein the electrical isolation layer is applied to a thickness of about 0.030 inches.

Element 11: wherein applying the electrical insulation includes applying the bond coat to the outer radial surface of the mandrel, and applying the electrical isolation layer on top of the bond coat. Element 12: further comprising applying the electrical isolation layer by thermal spraying. Element 13: further comprising applying a second sealant layer to the first sealant layer following heat treating the mandrel in the oven. Element 14: further comprising applying the second sealant layer to the first sealant layer prior to the mandrel reaching room temperature. Element 15: wherein applying the electrical insulation includes applying a buffer layer to the outer radial surface of the mandrel, applying the bond coat to the buffer layer, and applying the electrical isolation layer on top of the bond coat. Element 16: further comprising applying the electrical insulation to a reduced-diameter portion of the mandrel. Element 17: further comprising applying the electrical insulation to a thickness of about 0.030 inches.

Therefore, the embodiments herein are well adapted to attain the ends and advantages mentioned as well as those that are inherent therein. The particular embodiments disclosed above are illustrative only and may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the disclosure. The embodiments illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A mandrel, comprising:

an elongate body having a first end and a second end;

electrical insulation applied to at least a portion of the elongate body, the electrical insulation comprising a buffer layer over an outer radial surface of the elongate body, a bond coat bonded to the buffer laver, and an electrical isolation layer applied on top of the bond coat; and a first sealant layer applied to the electrical isolation layer.

2. The mandrel of claim 1, further comprising a second sealant layer applied to the first sealant layer.

3. The mandrel of claim 2, wherein the first and second sealant layers comprise a material selected from the group consisting of an epoxy, a phenolic, a furan, a polymethacrylate, a silicone, a polyester, a polyurethane, a polyvinylester, a wax, phosphoric acid, an aluminum phosphate, a sodium silicate, an ethyl silicate, chromic acid, and any combinations thereof.

4. The mandrel of claim 2, wherein the second sealant layer is applied to the first sealant layer following heat treatment of the mandrel.

5. The mandrel of claim 4, wherein the second sealant layer is applied to the first sealant layer prior to the mandrel reaching room temperature.

6. The mandrel of claim 1, wherein the first and second ends are coupled to uphole and downhole drill string sections, respectively.

7. The mandrel of claim 6, wherein the electrical insulation is applied to a reduced-diameter portion of the elongate body.

8. The mandrel of claim 1, wherein the bond coat comprises a material selected from the group consisting of a nickel-chromium alloy, molybdenum, a nickel-aluminum composite, aluminum bronze, pre-alloyed nickel aluminum, and a zinc-based alloy.

9. The mandrel of claim 1, wherein the electrical isolation layer comprises a material selected from the group consisting of zirconium oxide, aluminum oxide, chromium oxide, titanium oxide, dioxides thereof, baked glass, porcelain, a polymeric material, a resin material (including natural or synthetic) resins, plastics, and any composites thereof.

10. The mandrel of claim 9, wherein the electrical isolation layer is applied to a thickness of about 0.030 inches.

11. The mandrel of claim 1, wherein the buffer layer comprises austenitic nickel-chromium-based alloy.

* * * * *